US008534157B2

(12) United States Patent
O'Neill

(10) Patent No.: US 8,534,157 B2
(45) Date of Patent: Sep. 17, 2013

(54) ELECTRONIC THROTTLE CONTROL PEDAL ASSEMBLY WITH HYSTERESIS

(75) Inventor: Dan O'Neill, Chatham (CA)

(73) Assignee: KSR Technologies Co., Ridgetown (CA)

( * ) Notice: Subject to any disclaimer, the term of this patent is extended or adjusted under 35 U.S.C. 154(b) by 233 days.

(21) Appl. No.: 13/027,712

(22) Filed: Feb. 15, 2011

(65) Prior Publication Data

US 2011/0197700 A1 Aug. 18, 2011

Related U.S. Application Data

(60) Provisional application No. 61/305,372, filed on Feb. 17, 2010.

(51) Int. Cl.
*G05G 1/30* (2008.04)
*G05G 5/03* (2008.04)

(52) U.S. Cl.
CPC ... *G05G 1/30* (2013.01); *G05G 5/03* (2013.01)
USPC ..... 74/512; 74/513; 74/514; 74/560

(58) Field of Classification Search
USPC ..... 74/512–514, 560; 200/61.89, 86.5
See application file for complete search history.

(56) References Cited

U.S. PATENT DOCUMENTS

| | | | |
|---|---|---|---|
| 3,389,939 | A | 6/1968 | Skoyles |
| 3,741,610 | A | 6/1973 | Holland |
| 6,003,404 | A | 12/1999 | Hannewald |
| 6,098,971 | A | 8/2000 | Stege et al. |
| 6,209,418 | B1 | 4/2001 | Kalsi et al. |
| 6,289,762 | B1 | 9/2001 | Silva |
| 6,460,429 | B1 | 10/2002 | Staker |
| 6,474,191 | B1 | 11/2002 | Campbell et al. |
| 6,523,433 | B1 | 2/2003 | Staker |
| 6,658,963 | B2 | 12/2003 | Yaddehige |
| 6,725,741 | B2 | 4/2004 | Menzies |
| 6,745,642 | B2 | 6/2004 | Kumamoto et al. |
| 6,802,113 | B2 | 10/2004 | Staker |
| 6,834,564 | B2 | 12/2004 | Huesges et al. |
| 6,857,336 | B2 | 2/2005 | Staker |
| 7,051,616 | B2 | 5/2006 | Yokochi et al. |
| 7,073,408 | B2 | 7/2006 | Kim |
| 7,216,563 | B2 | 5/2007 | Willemsen et al. |
| 7,246,598 | B2 | 7/2007 | Meguro |
| 7,296,494 | B2 | 11/2007 | Caba et al. |
| 7,337,692 | B2 | 3/2008 | Willemsen et al. |

(Continued)

FOREIGN PATENT DOCUMENTS

| | | | |
|---|---|---|---|
| DE | 19701637 | A1 | 7/1998 |
| DE | 10135537 | A1 | 1/2003 |

(Continued)

*Primary Examiner* — Vinh Luong
*Assistant Examiner* — Brian McGovern
(74) *Attorney, Agent, or Firm* — Gifford, Krass, Sprinkle, Anderson & Citkowski, P.C.

(57) ABSTRACT

An electronic throttle control pedal assembly includes a housing having a cavity formed therein which is mounted to the vehicle. A hub is rotatably attached to the housing within the cavity. The hub includes at least a portion having a circumferential outer wall having an engagement portion. The pedal assembly includes a pedal arm having a pedal pad positioned at one end, and an opposite end operatively attached to the hub such that depression of the pedal pad rotates the hub.

19 Claims, 9 Drawing Sheets

(56) References Cited

U.S. PATENT DOCUMENTS

| | | | | |
|---|---|---|---|---|
| 7,387,047 | B2 | 6/2008 | Kim | |
| 7,404,342 | B2 * | 7/2008 | Wurn | 74/512 |
| 7,498,803 | B2 | 3/2009 | Horie et al. | |
| 2005/0097983 | A1 | 5/2005 | Mannle et al. | |
| 2006/0185469 | A1 | 8/2006 | Schlabach | |
| 2007/0137395 | A1 | 6/2007 | Ypma | |
| 2007/0137400 | A1 | 6/2007 | Campbell | |
| 2007/0157755 | A1 * | 7/2007 | Kim et al. | 74/513 |
| 2008/0149411 | A1 | 6/2008 | Schlabach et al. | |
| 2008/0276749 | A1 | 11/2008 | Stewart et al. | |
| 2008/0276750 | A1 | 11/2008 | Kim et al. | |
| 2011/0056326 | A1 * | 3/2011 | Kaijala | 74/512 |

FOREIGN PATENT DOCUMENTS

| | | | |
|---|---|---|---|
| EP | 0738622 | A2 | 10/1996 |
| EP | 748713 | A2 | 12/1996 |
| EP | 1914615 | A1 | 4/2008 |
| JP | 2007253869 | A | 10/2007 |
| WO | 2009087013 | A1 | 7/2009 |

* cited by examiner

ELECTRONIC THROTTLE CONTROL PEDAL ASSEMBLY WITH HYSTERESIS

CROSS-REFERENCE TO RELATED APPLICATIONS

This application claims priority of U.S. Provisional Patent Application Ser. No. 61/305,372 filed Feb. 17, 2010, which is hereby incorporated by reference.

FIELD OF THE INVENTION

The present invention relates to an electronic throttle control pedal assembly and, more particularly, to a pedal assembly having a hysteresis generating device.

BACKGROUND OF THE INVENTION

It is known to use pedal assemblies having position sensors to produce a "fly-by-wire" type pedal assembly for vehicle control such as brake and throttle operation rather than relying on a physical connection between the pedal and the vehicle control. A significant drawback of these pedal assemblies is that the removal of the physical connection of the pedal to the vehicle control removes the resistance or "pedal feel" that a driver is typically accustomed to sense during vehicle operation. As such, it is desirable to stimulate the feel of a mechanical pedal assembly.

Previously known pedal assemblies typically incorporate a spring to resist depression of the force on the pedal arm during depression of the pedal pad by the driver. However, although the compression of the spring resists depression, the springs do not simulate the "pedal feel" of a conventional pedal assembly which can be disorienting to a driver as the driver does not feel connected to the vehicle controls. Accordingly it is desirable to provide a hysteresis generating device which progressively increases the resistance to depression as the driver depresses the pedal arm.

SUMMARY OF THE INVENTION

The present invention provides an electronic throttle control pedal assembly which overcomes the above-mentioned problems of the previously known electronic throttle control pedal assemblies.

In brief, the electronic throttle control pedal assembly includes a housing having a cavity formed therein which is mounted to the vehicle. A hub is rotatably attached to the housing within the cavity. The hub includes at least a portion having a circumferential outer wall having an engagement portion. The pedal assembly includes a pedal arm having a pedal pad positioned at one end, and an opposite end operatively attached to the hub such that depression of the pedal pad rotates the hub.

A hysteresis generating device is positioned within the cavity of the housing so as to progressively increase the resistance to the depression of the pedal arm. The hysteresis generating device includes a slide member which is slidably attached to an interior surface of the housing. The slide member includes an abutment end having a generally arcuate configuration and an opposite contact end. A wedge member is positioned adjacent the contact end of the slide member such that depression of the pedal arm forces the wedge member against the contact end to slide member towards the hub. The movement of the slide member forces the abutment end of the slide member into engagement with the engagement portion of the hub thereby generating resistance to depression of the pedal arm.

In one embodiment the pedal arm includes a generally L-shaped configuration having an elongated leg and an arm extending generally normal to the elongated leg. A pedal pad is positioned at one end of the elongated leg and the arm extends from an opposite end of the elongated leg. In this configuration, the hub is formed as a distal portion of the arm such that the entire pedal arm is pivotal about the rotational axis of the hub. A spring pocket is formed adjacent the hub in the arm. A biasing member has one end positioned within the pocket formed in the arm and an opposite end in engagement with the wedge member.

In an alternative embodiment, the pedal arm is hingedly connected to the housing by a living hinge, and includes an extension arm extending at least partially within the housing. The hub includes a first arm having a hook formed at the distal end thereof which engages with the extending arm of the pedal arm such that depression of the pedal arm rotates the hub. The hub further includes a second arm which extends from an opposite side of the hub from the first arm. The second arm includes a cylindrical pocket for receiving one end of the biasing member.

One advantage of the present invention is that the electronic throttle control pedal assembly is provided with a hysteresis generating device which progressively increases the resistance to the pedal depression. The progressive increase of resistance as the pedal is depressed provides the driver with a more realistic feel of a mechanical pedal assembly. Other features and advantages of the present invention will be readily understood as the same becomes better understood upon reading the subsequent description when considered in connection with the accompanying drawings.

BRIEF DESCRIPTION OF THE DRAWINGS

A better understanding of the present invention will be had upon reference to the following detailed description when read in conjunction with the accompanying drawings, wherein like reference characters refer to like parts throughout the several views and in which.

DETAILED DESCRIPTION OF THE INVENTION

Figure 1:
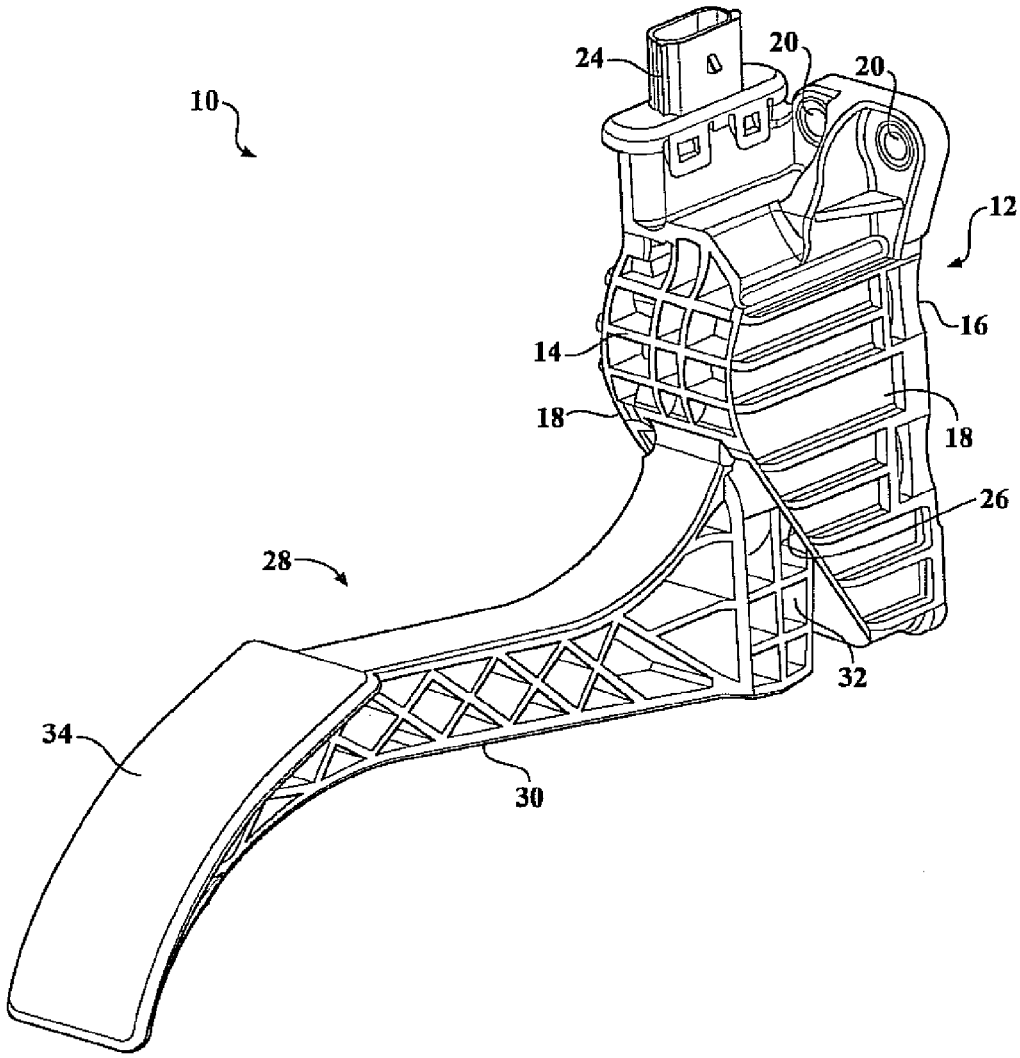
FIG. 1 is a front side perspective view of the inventive pedal assembly.

The present invention has utility as an electronic throttle control pedal assembly for use with an automotive vehicle which overcomes the above-mentioned disadvantages. The inventive electronic pedal assembly includes a hysteresis generating device which simulates the feel of a conventional mechanical pedal assembly. The hysteresis generating device includes a slide member which is driven into an engagement portion of a hub by a spring biased wedge member upon the depression of the pedal. The engagement of the slide member with the hub allows for the progressive increase of resistance to depression thereby simulating the feel of a conventional mechanical pedal assembly.

Referring to FIGS. 1-6, a first embodiment of an electronic throttle control pedal assembly for generating hysteresis to simulate the feel of a conventional mechanical pedal assembly is generally illustrated at 10. The pedal assembly includes a housing bracket 12 for securing the pedal assembly 10 to a portion of the automotive vehicle. In the illustrated example, the housing bracket 12 is attached to a portion of the firewall (not shown) of the vehicle.

The housing bracket 12 includes a front wall 14, an opposite rear wall 16, and a pair of opposing side walls 18 which traverse the front wall 14 and the rear wall 16. The rear wall 16 of the housing bracket 12 is formed of a generally planar surface for attaching the housing bracket 12 to the firewall (not shown) of the vehicle. The rear wall 16 includes at least one aperture 20 for securing the housing bracket 12 to the vehicle using any known fastener or attaching means to secure one object to another illustratively including bolting, screwing, welding, or adhesive.

Figure 2:
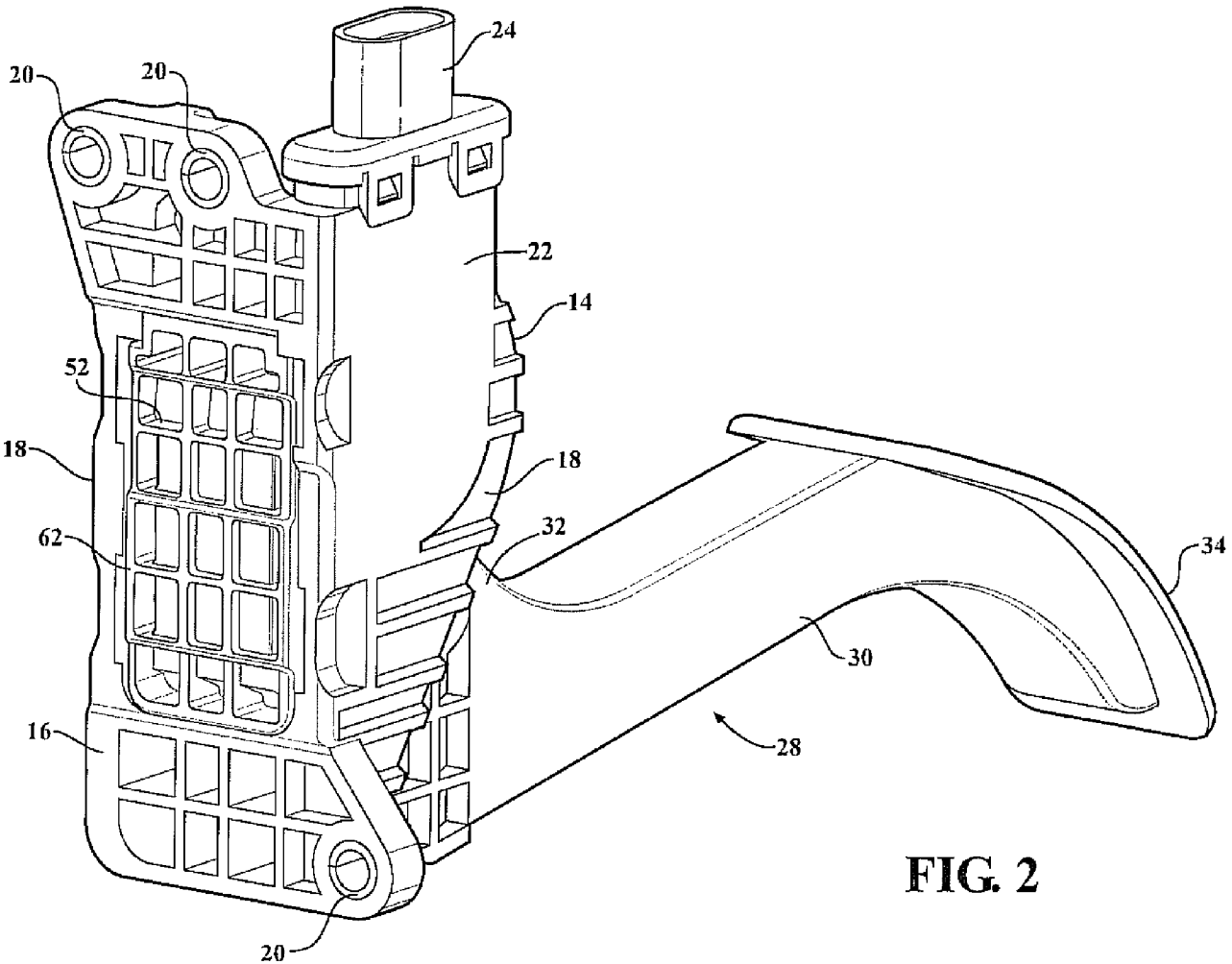
FIG. 2 is a rear side perspective view of the pedal assembly.

As best seen in FIG. 2, one of the side walls 18 includes a molded pocket 22 which contains elements of a position sensor 46, which will be described in greater detail below. A plug 24 is affixed to a top edge of the pocket 22 for the attachment of a wiring harness (not shown). The wiring harness transmits the signal from the position sensor to the vehicle control such as a brake assembly or throttle control to control the vehicle operation.

The housing bracket 12 has a generally boxlike structure having a cavity or interior portion defined by the rear wall 14, front wall 16, and the side walls 18. The front wall 14 includes an opening 26 through which a portion of a pedal arm 28 extends.

The pedal arm 28 has a generally L-shaped configuration defined by an elongated leg 30 and an arm 32 extending generally normal from the elongated leg 30. A pedal pad 34 is secured to a distal, lower end of the elongated leg 30. In this example the pedal pad 34 has a generally rectangular shape and is formed of an isometric material such as a rubber as the pedal pad 34 contacts the foot of a driver so as to control vehicle operations. The arm 32 extends from an opposite end of the elongated leg 30 from the pedal pad 34. A portion of the arm 32 extends through the opening 26 formed in the front wall 14 and extends into the cavity or interior portion of the housing bracket 12.

Figure 3A:
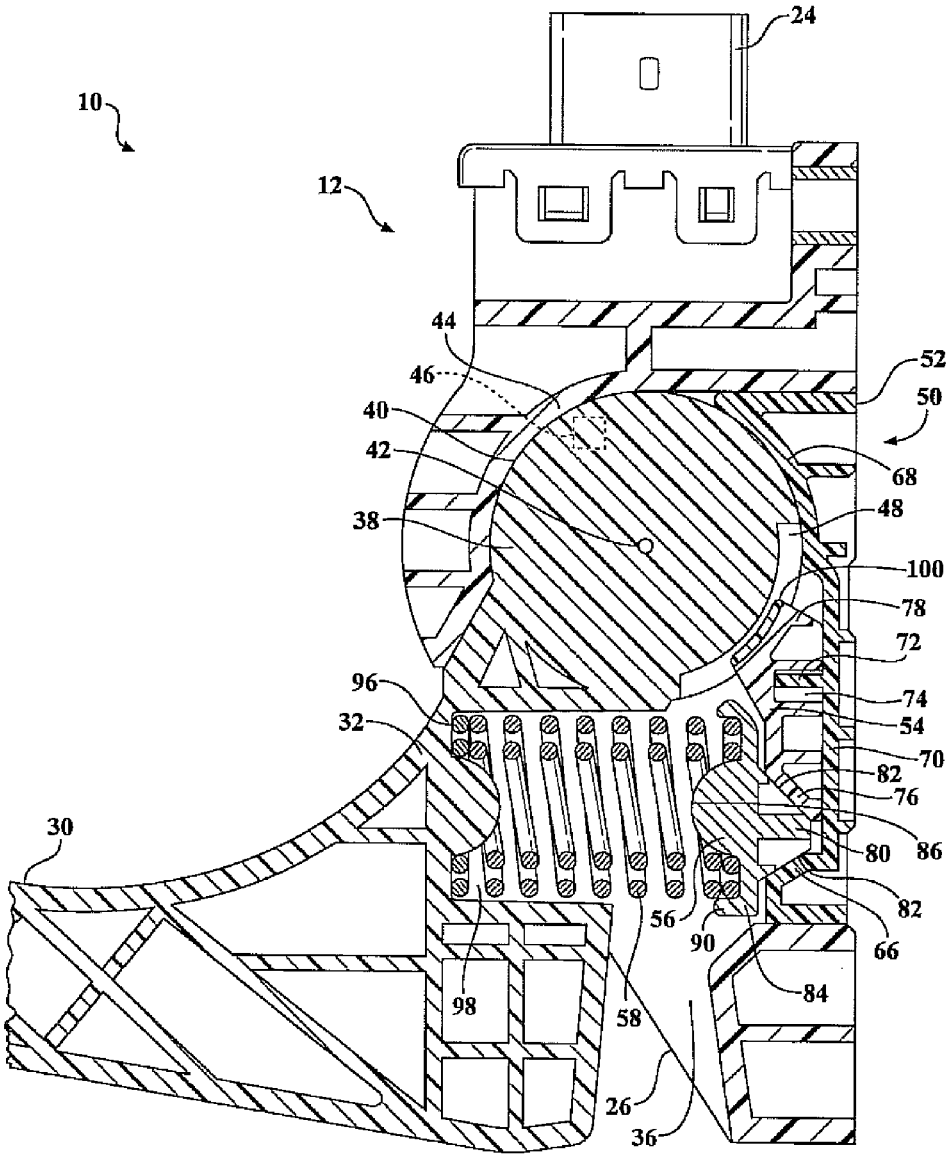
FIG. 3A is a partial cross-sectional view illustrating the pedal arm in an initial position.
Figure 3B:
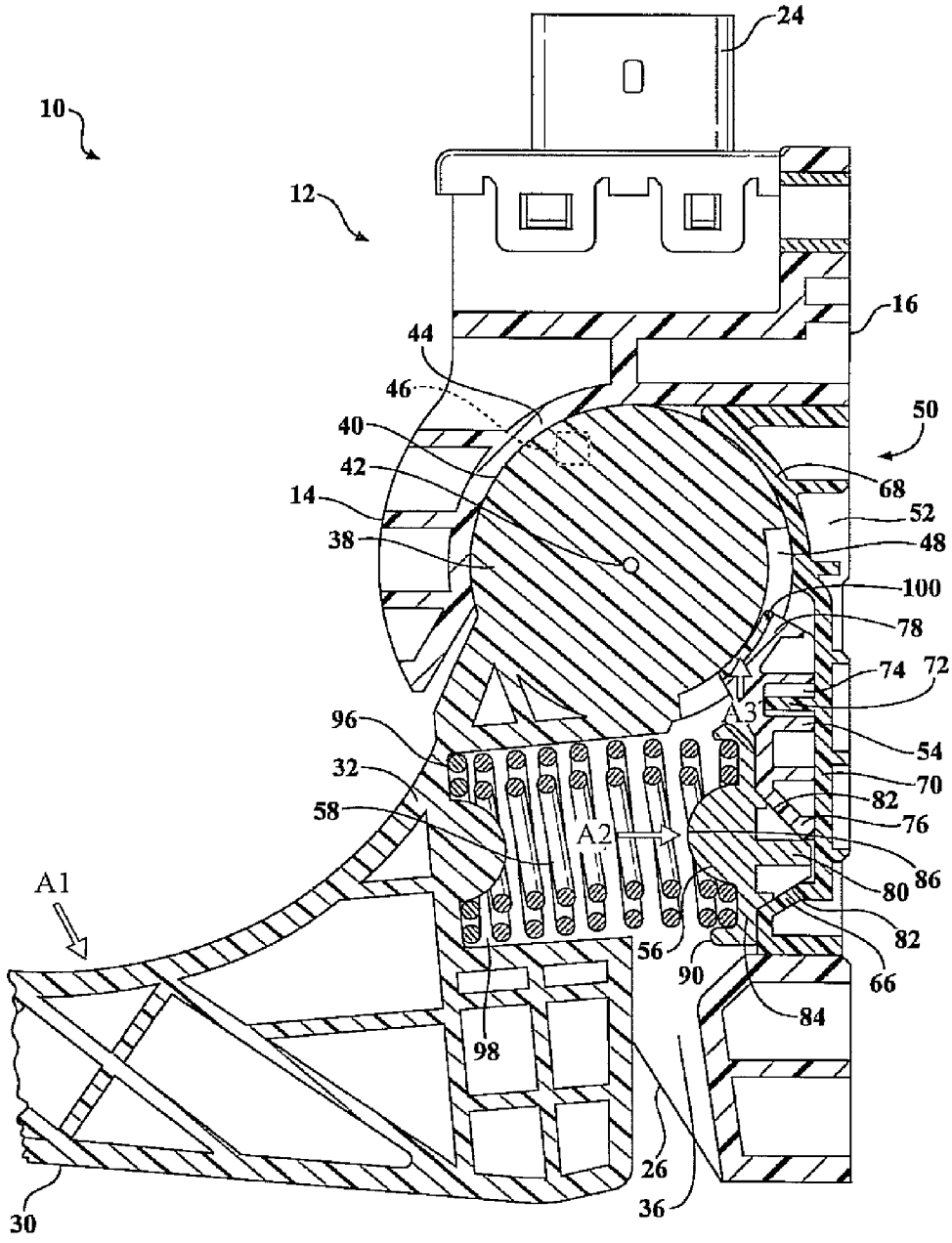
FIG. 3B is a partial cross-sectional view illustrating the pedal arm in a partially depressed position and the engagement of the hysteresis generating device.

Referring to FIGS. 3A and 3B, the internal configuration of the pedal assembly 10 will now be described. The housing bracket 12 includes an internal cavity 36. The arm 32 of the pedal arm 28 has a hub 38 formed integrally therewith at a distal end. The hub 38 has a generally circumferential outer wall 40 and has a center portion 42 which is rotatably mounted to the housing bracket 12 in any known manner such as by the engagement of pins extending from or into the central portion 42 of the hub 38. As such, the hub 38 rotates about the central portion 42 which defines a pivot axis for the pedal arm 28. The internal surface of the front wall 14 includes an arcuate surface 44 which is complementary in shape to the circumferential outer wall 40 of the hub 38 to guide the rotation of the hub 38 and the pivoting of the pedal arm about the central portion 42.

The rotation of the hub 38 about the central portion 42 is sensed by a position sensor 46, such as a non-contacting position sensor. In such an example, the position sensor 46 utilizes coils which are mounted on the sensor pocket 22 covered by a cover in order to create eddy currents which are measured and then delivered to the vehicle control such as the brake assembly or the throttle control for controlling operation of the vehicle. The signals generated by the position sensor 46 are transferred to the vehicle controls via the wiring harness attached to the plug 24.

In the alternative, the position sensor 46 is optionally attached to the interior portion of the pocket 22 which when attached to the housing bracket 12 positions the position sensor 46 adjacent the hub 38 such that the rotation of the hub 38 can be accurately sensed. Further, the position sensor 46 is connected to a circuit board (not shown) which engages with the plug 24 to transmit the position signals to the vehicle controls via the wiring harness. It is appreciated, of course, that various other types of positioning sensors may be utilized without deviation from the scope of the invention.

Figure 5:
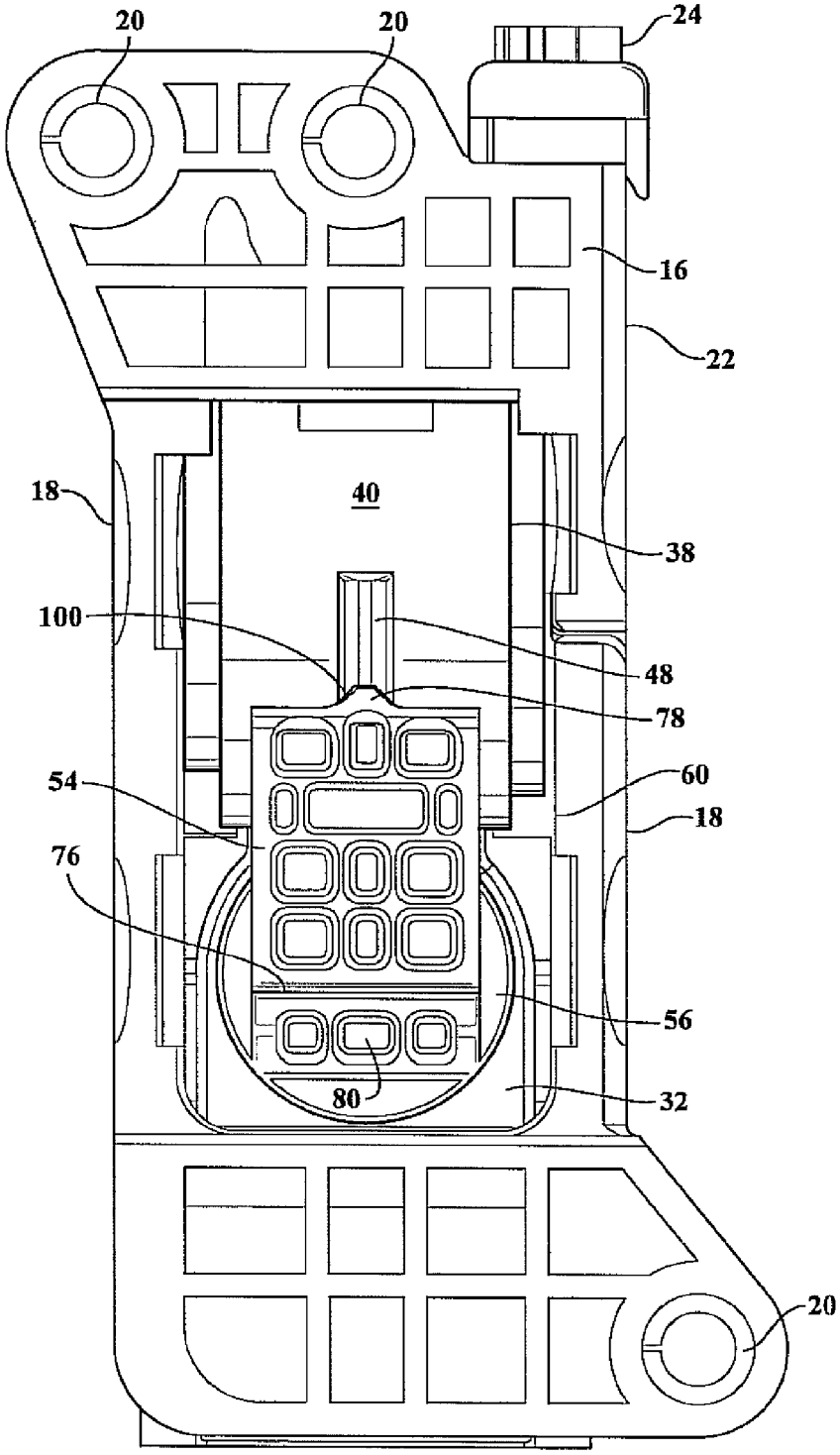
FIG. 5 is a rear plane view of the inventive pedal assembly with the insert removed from the housing.

The hub 38 includes a friction engagement portion 48 formed in the outer circumferential wall 40. The friction engagement portion 48 is formed by radially stepping a portion of the circumferential outer wall 40 inwardly to form a channel or trough. The friction engagement portion 48 extends radially along a portion of the circumferential outer wall 40 of the hub 38. Specifically, the friction engagement portion 48 extends about one quarter of the entire circumferential portion of the hub 38. As best seen in FIG. 5, the friction engagement portion 48 is formed of a generally inwardly extending V shape such that the friction engagement portion 48 is at its widest adjacent the circumferential outer wall 40 and tapers or narrows as the friction engagement portion 48 extends inwardly towards the central portion 42 of the hub 38.

Figure 4:
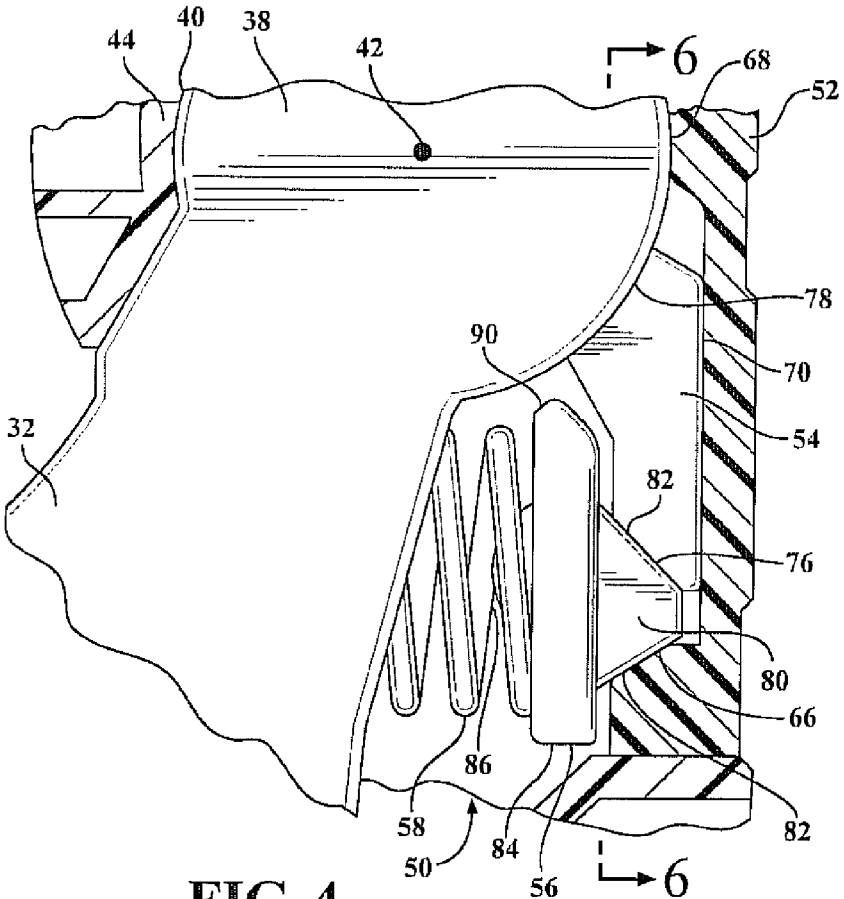
FIG. 4 is a partial cross-sectional view illustrating the interaction of the hysteresis generating device.

In order to simulate the feel of a conventional mechanical pedal operation, the inventive pedal assembly 10 includes a hysteresis generating device 50 which provides the vehicle driver with resistance to the pedal depression. As best seen in FIG. 4, the hysteresis generating device 50 includes an insert 52, a slide member 54, a wedge member 56, and a biasing member 58. The insert 52 is positioned within an aperture 60 formed in the generally planar mounting surface of the rear wall 16, as best seen in FIG. 5. The insert includes an exterior surface 62 which extends flush with the mounting surface of the rear wall 16, as best seen in FIG. 2. The insert 52 is optionally received within the aperture 60 in a snap fit engagement or, in the alternative, the insert 52 connects to the rear wall 16 of the housing bracket 12 through the use of a fastener. The removable insert 52 is generally advantageous as the disconnection of the insert 52 from the housing bracket 12 allows for access to the cavity 36 and the remaining portions of the hysteresis generating device 50 thereby providing a reduction in time required for assembly and maintenance.

With reference to FIGS. 3A, 3B, and 4, an interior portion of the insert 52 which faces the cavity 36 includes a sloped surface 66 at one end and a curved surface 68 disposed at an opposite end. The curved surface 68 is formed complementary to the circumferential outer wall 40 of the hub 38 similar to the arcuate wall 44 formed at the interior surface of the rear wall 14. The curved surface 68 of the insert 52 has a radius of curvature which is slightly larger than the circumferential outer wall 40 of the hub 38 and acts as a guide for the hub 38 during rotation.

Positioned between the sloped end 66 and the curved surface 68 is a generally planar portion 70. A guide 72 extends generally normal from the planar surface 70. The slide member 54 is slidably attached to the generally planar portion 70 of the insert 52. The slide member 54 includes a cavity 74 formed on the side facing the interior surface of the insert 52. The cavity 74 receives the guide 72 extending from the generally planar portion 70 of the insert 52. The engagement of the cavity 74 and the guide 72 restricts the sliding movement of the slide member 54 such that the slide member 54 is allowed to slide along a predetermined portion of the generally planar surface 70 in the direction between the sloped surface 66 and the curved surface 68.

Figure 6:
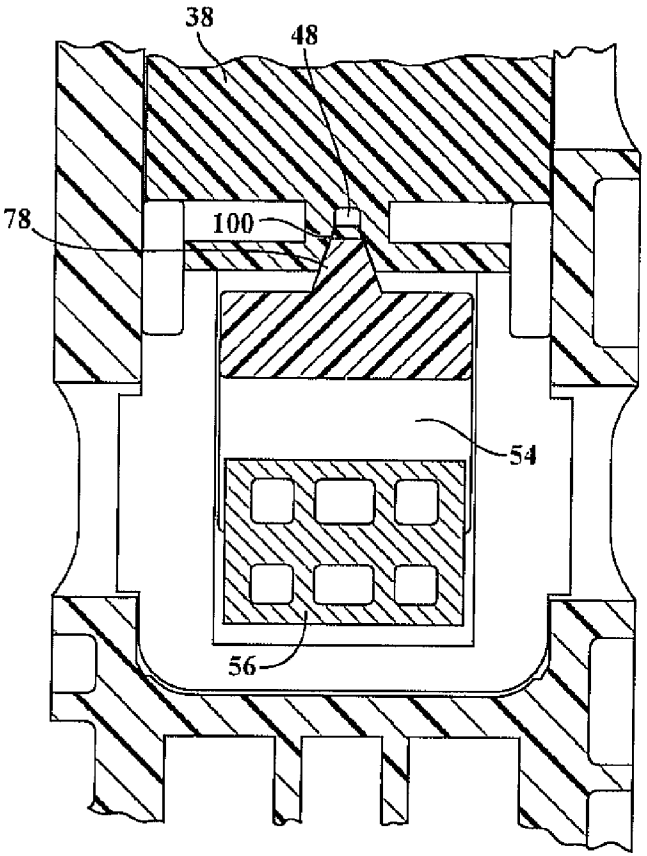
FIG. 6 is a partial cross-sectional view of the pedal assembly with the pedal arm removed.

The slide member 54 includes an angled surface 76 at an end facing the sloped surface 66 of the insert 52. An opposite end of the slide member 54 which faces the curved surface 68 of the insert 52 has a generally arcuate surface complementary to the engagement portion 48 of the hub 38. As best seen in FIGS. 5 and 6, the abutment end having an arcuate surface 78 of the slide member 54 is formed as a projection having a complementary shape to the friction engagement portion 48 of the hub 38 and which includes a radius of curvature similar to the radius of curvature of the friction engagement portion 48. The engagement of the arcuate surface 78 of the slide member 54 with the friction engagement portion 48 of the hub 38 will be described in greater detail below.

The sloped surface 66 of the insert 52 and the angled surface 76 of the slide member 74 form a generally V-shape. The wedge member 56 includes a wedged portion 80 formed by a pair of angled surfaces 82 extending from a central portion 84. The wedged portion 80 engages with the V-formation formed by the sloped surface 66 of the insert 52 and the angled surface 76 of the slide member 54. The central portion 84 of the wedge member 56 includes a generally circular cross section and a retaining member 86 formed on a side opposite the wedge portion 80. The retaining member 86 includes a bulbous protrusion centrally disposed within the central portion 84. A lip 90 extends around the periphery of the central portion 84.

The biasing member 58 includes a wedge end 92 and a pedal end 96. The wedge end 92 is retained within the central portion 84 of the wedge member 56 by the lip 90 and the retaining member 86. The pedal end 96 of the biasing member 58 is received within a cylindrical pocket 98 formed in the arm 32 of the pedal arm 28. The cylindrical pocket 98 is formed in the arm 32 adjacent the hub 38.

The biasing member 58 is optionally a pair of springs. The pair of springs includes an outer spring and an inner spring which extends coaxially with the outer spring. The biasing member 58 is used in part to bias the pedal arm 28 towards the initial or non-depressed position, and to actuate the hysteresis generating device 50.

In order to facilitate a better understanding of the first embodiment of the present invention, the operation of the pedal assembly 10 will now be described. During pedal operation a driver actuates the pedal assembly 10 by depressing the pedal pad 34. The depression of the pedal pad causes the pedal arm 28 to pivot about the central portion 42 of the hub 38. The hub 38 rotates guided by the arcuate wall 44 and the curved surface 68 of the insert 52. The rotation of the hub 38 causes the pedal arm 28 to pivot which compresses the biasing member 58 through the displacement of the pedal end 96 towards the hysteresis generating device 50, specifically, the wedge member 56. The displacement of the pedal end 96 of the biasing member 58 forces the wedge end 92 in the direction of the rear wall 16. The displacement causes the wedge portion 80 to abut the sloped surface 66 of the insert 52 and the angled side 76 of the slide member 54. As the wedge portion 80 moves from the front wall 14 in the direction towards the rear wall 16, the slide member 54 slides upon the planar portion 70 of the insert 52 due to the contact of the angled side 82 and the angled surface 76.

As the slide member 54 slides from the sloped surface 66 towards the curved surface 68, the arcuate portion 78 engages with the friction engagement portion 48. The insertion of the arcuate surface 78 of the slide member 54 into the friction engagement portion 48 causes friction due to the contact of the arcuate surface 78 with the friction engagement portion 48. The friction caused by the contact of the arcuate surface 78 and the friction engagement portion 48 thereby generates resistance or hysteresis to simulate the feel of a conventional mechanical pedal assembly.

As seen in FIG. 3B, the depression of the pedal arm 28 in the direction of arrow A1 from the initial position towards the depressed position displaces the wedge portion 80 in the direction of arrow A2 which forces the wedge portion 80 into engagement with the slide member 54, specifically the angled side 76. The abutment of the wedge portion 80 causes the slide member 54 to slide so as to be linearly displaced in the direction of arrow A3 which introduces more of the abutment end having the arcuate surface 78 into engagement with the friction engagement portion 48 in order to generate additional resistance to the depression of the pedal arm 28. As clearly seen in FIG. 3B, the directions of arrows A2 and A3 are nonparallel, and in particular generally normal. Accordingly, the force applied to the pedal pad 34 is transmitted to the slide member 54 via the wedge member 56 thereby increasing resistance in step with the amount of force applied to the pedal arm 28.

The interaction of the guide 72 formed on the generally planar portion 70 of the insert 52 and the cavity 74 of the slide member 54 is provided as a limit to the amount of movement the slide member 54 can be slid in the direction of the curved surface 68 of the insert 52. Further, a friction pad 100, formed of high friction material, is optionally attached to either the interior surface of the arcuate surface 78 of the slide member 54 or into the channel or trough formed in the friction engagement portion 48 in order to increase the amount of friction produced by the engagement of the arcuate surface 78 into the friction engagement portion 48.

Figure 7:
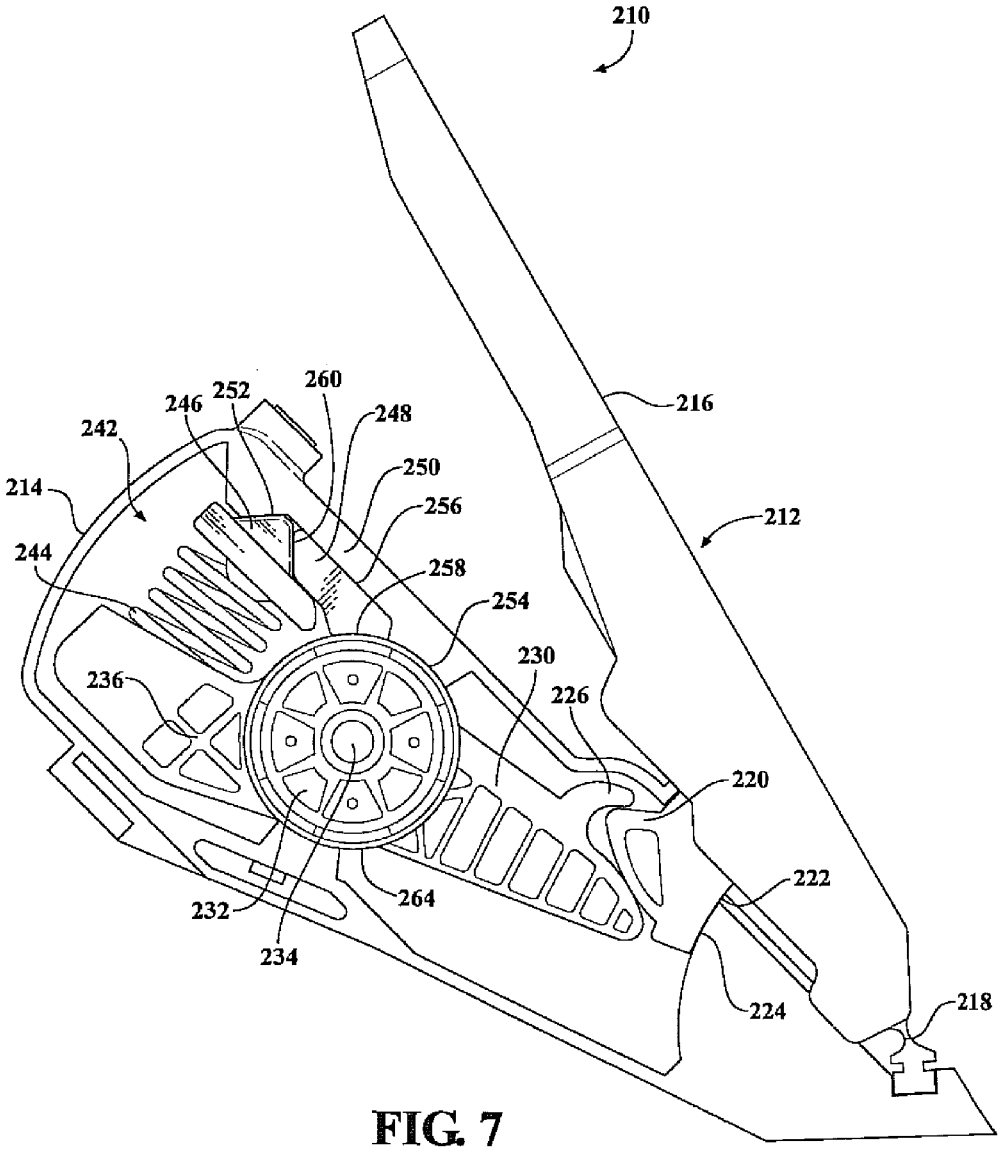
FIG. 7 is an alternative embodiment of the pedal assembly.
Figure 8:
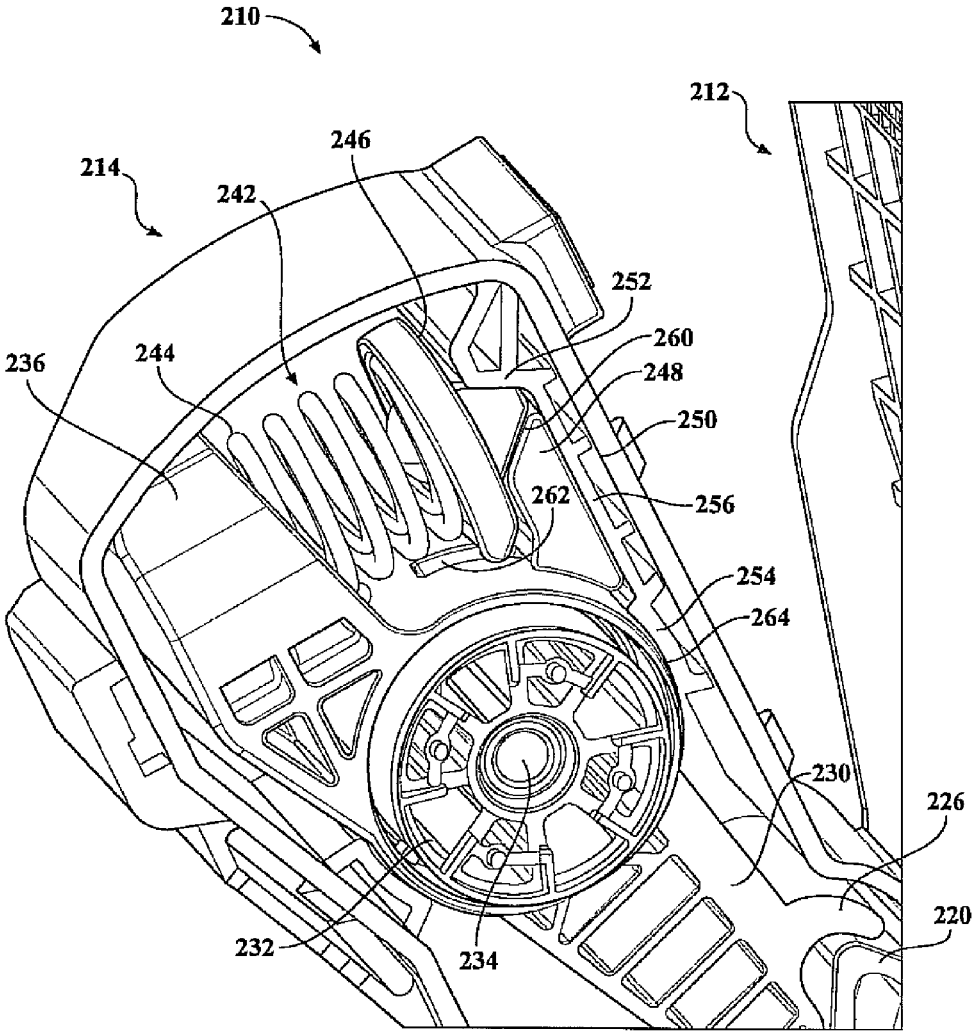
FIG. 8 is a perspective view illustrating the interaction of the hysteresis generating device of the second embodiment.
Figure 9:
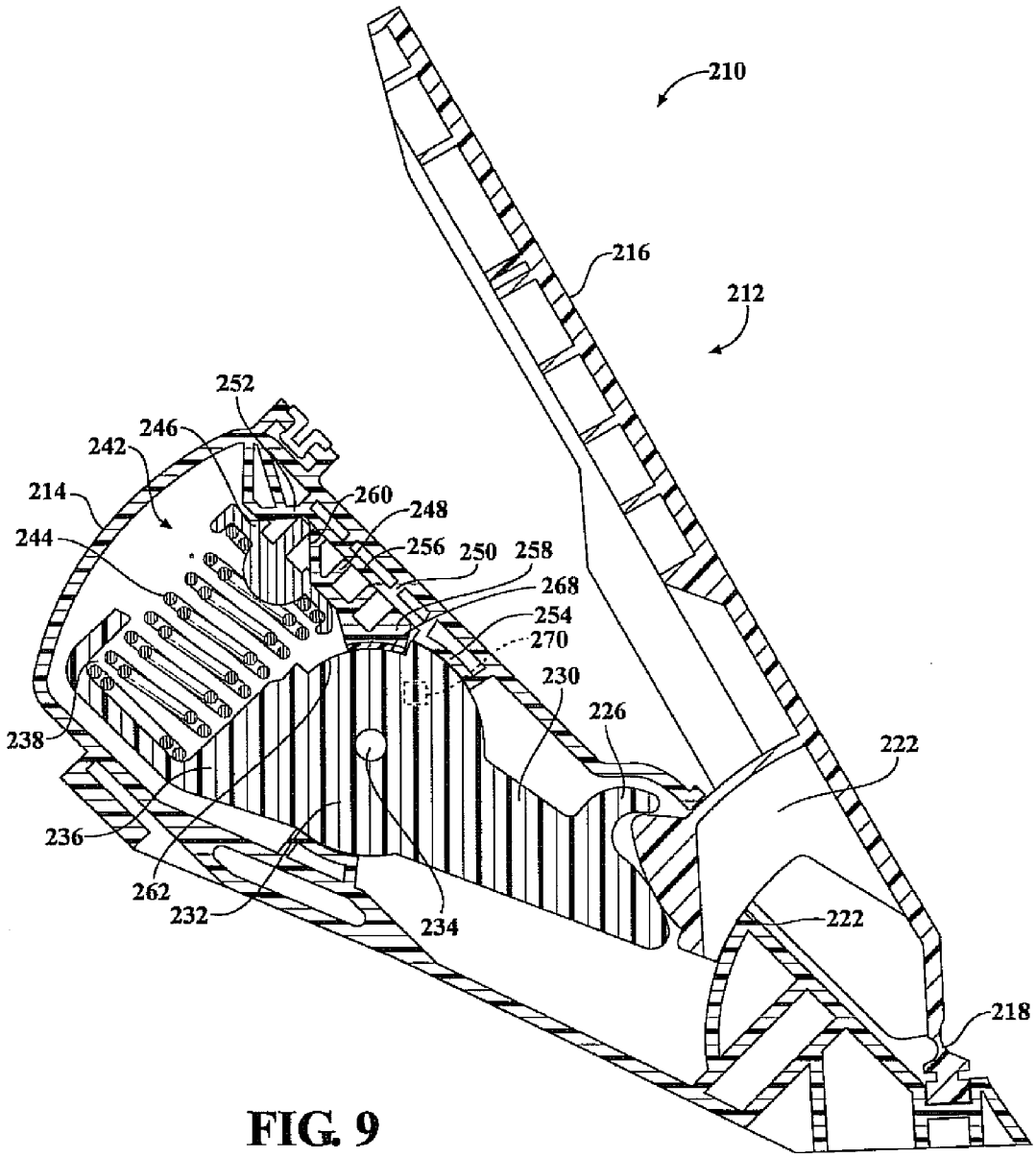
FIG. 9 is a partial cross-sectional view of the second embodiment of the pedal assembly.

With reference to FIGS. 7-9, an alternative embodiment of the inventive pedal assembly having the hysteresis generating device is generally illustrated at 210. The second embodiment of the pedal assembly 210 is an organ style pedal assembly which mounts to the floor (not shown) of the vehicle. The pedal assembly 210 includes a pedal arm 212 and a mounting bracket 214.

The pedal arm 212 includes a pedal pad 216 optionally formed of an isometric material so as to provide friction between the pedal pad 216 and a driver's foot. The pedal arm 212 connects to the mounting bracket 214 at a lower edge by a living hinge 218 which pivotally connects the pedal arm 212 to the housing bracket 214. An extension 220 extends outwardly from the pedal arm on a side opposite the pedal pad 216. The extension 220 extends through an opening 222 formed in the housing bracket 214 and abuts a guide portion 224. The pedal arm 212 pivots about the living hinge 218 and is guided along a predetermined pedal path by the interaction of the extension 220 and the curved portion 224.

A hub 232 is rotatably mounted to the housing bracket 214 such that the hub 232 rotates about a central portion 234 upon depression of the pedal pad 216. The extension 220 engages with a hook 226 formed on a first arm 230 extending outwardly from the hub 232. The hub 232 rotates about the central portion 234 in response to depression of the pedal arm 212. A second arm 236 extends outwardly from the hub 232 on a side opposite from the first arm 230.

Positioned within the housing bracket 214, is a hysteresis generating device 242. The hysteresis generating device 242 includes biasing member 244, wedge member 246, and slide member 248. An interior surface 250 of the housing bracket 212 includes a sloped surface 252, a curved surface 254, and a generally planar surface 256 disposed between the sloped surface 252 and the curved surface 254. The slide member 248 is slidably attached to the interior surface 250, specifically the planar surface 256. The slide member 248 includes an angled end 260 and an abutment or arcuate end 258 which corresponds in shape and curvature to a stepped in friction engagement portion 262 formed in the circumferential outer wall 264 of the hub 232. The arcuate end 258, the friction engagement portion 262, or both optionally include a friction pad 268 formed of a high friction material to increase the friction and therefore the hysteresis generated by the engagement of the arcuate end 258 and the friction engagement portion 262.

The hysteresis generating device 242 is substantially similar to the hysteresis generating device 50 of the first embodiment. The hysteresis generating device 242 generates hysteresis due to the engagement of the arcuate end 258 into the friction engagement portion 262 due to the sliding of sliding member 248 caused by downward movement of the wedge member 246 caused by rotation of the hub 232 about central portion 234 in response to depression of the pedal arm 212. The difference between the hysteresis device 242 and hysteresis device 50 is the attachment of the biasing member 244 to the hub 232.

Biasing member 244, optionally a pair of springs including an outer spring and an inner spring extending coaxially with the outer spring, includes a wedge end 264, which connects to the wedge member 246 in a manner similar to the wedge member 56, and an arm end 266. As best seen in FIG. 9, the second arm 236 includes a cylindrical pocket 238 which engages with the arm end 266 of the biasing member 244. As such, the arm end 266 of the biasing member 244 of the hysteresis device 242 connects to the second arm 236 extending radially outwardly from the hub 232, rather than connecting to the pocket 98 formed in the arm 32 of the pedal arm 28 as in the hysteresis generating device 50.

The operation of the pedal assembly 210, specifically the hysteresis generating device 242, is similar to the operation of the hysteresis generating device 50 of a first embodiment in that depression of the pedal arm 212, specifically the pedal pad 216, operates to rotate the hub 232 about central portion 234. The rotation of the hub 232 rotates the second arm 236 which acts to compress the biasing member 244. The compression of the biasing member 244 forces the wedge member 246 to engage the slide member 248. The slide member 248 slides and the arcuate end 258 engages with the friction engagement portion 262 formed in the hub 232 so as to generate resistance to the depression of the pedal pad 216 thereby simulating the feel of a conventional mechanical pedal assembly.

A sensor 270 is used to detect the operation of the pedal arm 212. Specifically, the rotation of the hub 232 about the central portion 234 is sensed by the position sensor 270, such as a non-contacting position sensor. It is appreciated, of course, that various other types of positioning sensors may be utilized without deviation from the scope of the invention.

It is appreciated, of course, that the inventive pedal assemblies 10 and 210 are not limited to electronic throttle control pedals. The inventive pedal assemblies 10 and 210 are optionally used for controlling any vehicle operation illustratively including brake control, clutch control or any other operation which requires the pedal to simulate the feel of a mechanically connected pedal.

The present invention has been described in an illustrative manner. It is to be understood that the terminology which has been used is intended to be in the nature of words of description rather than of limitation. Many modifications and variations of the present invention are possible in light of the above teachings. Therefore, within the scope of the appended claims, the present invention may be practiced other than as specifically described.

It is claimed:

1. An electronic pedal assembly for use with an automotive vehicle, said pedal assembly comprising:

a housing having a cavity, said housing adapted for mounting said pedal assembly to the vehicle;

a hub disposed within said cavity and said hub pivotally connected to said housing, at least a portion of said hub having an outer wall having an engagement portion;

a pedal arm connected to said hub;

a slide member slidably attached to an interior surface of said housing, said slide member having an abutment end and a contact end; and a wedge member positioned adjacent said contact end of said slide member such that depression of said pedal arm displaces said wedge member in a first direction, said wedge member abuts said contact end of said slide member to linearly displace said slide member in a second direction away from said wedge member to engage said abutment end of said slide member with said engagement portion to generate hysteresis, said second direction being nonparallel with said first direction;

wherein said wedge member is biased against said contact end of said slide member by a biasing member.

2. The electronic pedal assembly of claim 1, wherein said engagement portion of said outer wall of said hub is a stepped in portion.

3. The electronic pedal assembly of claim 2, wherein said abutment end of said slide member is wider at a base than at a distal end, and wherein said stepped-in portion of said outer wall has a generally v-shape.

4. The electronic pedal assembly of claim 1, wherein said outer wall is generally circumferential, and wherein said abutment end has an arcuate shape.

5. The electronic pedal assembly of claim 4, wherein one of said engagement portion of said circumferential outer wall and said abutment end of said slide member includes a friction generating material.

6. The electronic pedal assembly of claim 4, wherein said abutment end of said slide member has a radius of curvature generally equal to a radius of said engagement portion of said hub.

7. The electronic pedal assembly of claim 1, wherein said wedge member is positioned between an angled surface formed in said interior surface of said housing and said contact end of said slide member.

8. The electronic pedal assembly of claim 7, wherein said contact end of said slide member is angled.

9. The electronic pedal assembly of claim 1, wherein said biasing member is a spring.

10. The electronic pedal assembly of claim 1, wherein said biasing member includes a first end and a second end, said first end positioned within a pocket formed in said pedal arm, and said second end attached to said wedge member.

11. The electronic pedal assembly of claim 1, wherein said hub includes a first arm which engages with said pedal arm, and an opposite second arm having a pocket, and wherein said biasing member includes a first end and a second end, and said first end of said biasing member is positioned at least partially within said pocket, and said second end of said biasing member attaches to said wedge member.

12. The electronic pedal assembly of claim 11, wherein said first arm includes a hook which engages with said pedal arm such that depression of said pedal arm rotates said hub.

13. The electronic pedal assembly of claim 12, wherein said pedal arm includes an extension member which engages with said hook, and wherein said pedal arm is connected to said housing by a living hinge.

14. The electronic pedal assembly of claim 10, wherein said pedal arm has a generally L-shape including an elongated leg having a pedal pad disposed at one end, and an arm extending from an opposite end, and wherein said hub is formed at a distal end of said arm.

15. The electronic pedal assembly of claim 14, wherein said pocket is formed adjacent said distal end of said arm.

16. The electronic pedal assembly of claim 14, wherein said hub is formed at said distal end of said arm of said pedal arm.

17. The electronic pedal assembly of claim 4, wherein said engagement portion of said circumferential outer wall has a first shape, and said abutment end of said slide member has a second shape complementary to said first shape of said engagement portion.

18. The electronic pedal assembly of claim 1, wherein said slide member is slidably attached to a snap-in insert connected to said housing.

19. The electronic pedal assembly of claim 18, wherein said insert includes a curved surface disposed at one end and an angled surface disposed at an opposite end, said curved surface having a curvature complementary to said circumferential outer wall of said hub so as to guide said hub during pivotal movement, and wherein said slide member is disposed between said angled surface and said curved surface with said wedge member disposed between said angled surface of said insert and said contact surface of said slide member.

* * * * *